US008683686B2

(12) United States Patent
Enomoto et al.

(10) Patent No.: US 8,683,686 B2
(45) Date of Patent: Apr. 1, 2014

(54) METHOD FOR CONNECTING CONNECTOR TERMINAL

(75) Inventors: Noritsugu Enomoto, Tokyo (JP); Shigeki Motomura, Tokyo (JP); Takenobu Yabu, Tokyo (JP)

(73) Assignees: Furukawa Electric Co., Ltd, Tokyo (JP); Furukawa Automotive Systems Inc., Shiga (JP)

( * ) Notice: Subject to any disclaimer, the term of this patent is extended or adjusted under 35 U.S.C. 154(b) by 768 days.

(21) Appl. No.: 12/670,067

(22) PCT Filed: Jul. 22, 2008

(86) PCT No.: PCT/JP2008/001951

§ 371 (c)(1),
(2), (4) Date: Jan. 21, 2010

(87) PCT Pub. No.: WO2009/013896

PCT Pub. Date: Jan. 29, 2009

(65) Prior Publication Data

US 2010/0186229 A1 Jul. 29, 2010

(30) Foreign Application Priority Data

Jul. 24, 2007 (JP) ..... 2007-191936

(51) Int. Cl.
*H01R 43/04* (2006.01)

(52) U.S. Cl.
USPC ..... 29/866; 29/857; 29/865

(58) Field of Classification Search
USPC ..... 29/857, 861, 863; 439/422
See application file for complete search history.

(56) References Cited

U.S. PATENT DOCUMENTS 3,924,917 A * 12/1975 Munshower ..... 439/422
4,066,319 A * 1/1978 Baker et al. ..... 439/422
4,630,362 A * 12/1986 Bauer et al. ..... 29/751

FOREIGN PATENT DOCUMENTS

| | | | |
|---|---|---|---|
| JP | 117648/1978 | | 3/1980 |
| JP | 2002-246091 | A | 8/2002 |
| JP | 2002-313150 | A | 10/2002 |
| JP | 2003-123886 | A | 4/2003 |
| JP | 2003-142796 | | 5/2003 |
| JP | 2003-297468 | A | 10/2003 |
| JP | 2004-103447 | A | 4/2004 |
| JP | 2004-311133 | A | 11/2004 |
| JP | 2005-122901 | A | 5/2005 |

OTHER PUBLICATIONS

International Search Report mailed Sep. 9, 2008 for PCT Application No. PCT/JP2008/001951, 4 pages.

* cited by examiner

*Primary Examiner* — Carl Arbes
(74) *Attorney, Agent, or Firm* — Turocy & Watson, LLP

(57) ABSTRACT

A method is provided for firmly connecting a connector terminal to a flat conductor. This is a method for electrically connecting the pierce terminal 20 having pierce blades 21 that pierce through the flat conductor 102 with the flat conductor 102 by the pierce blades 21, in which the connection state is adjusted based on a terminal reaction force R acting on the pierced blade 21*a* by a ruptured end surface 102*a* of the flat wiring conductor 102. The adjustment of the terminal reaction force R is made by adjusting a pressing reaction force F/A generated when the pierce blade 21 pierces through the flat wiring conductor 102.

5 Claims, 5 Drawing Sheets

20 PIERCE TERMINAL
21 PIERCE BLADE
21a side surface
30 BACKUP PLATE
31 INSERTION HOLE
102 FLAT WIRING CONDUCTOR
X LONGITUDINAL DIRECTION
Y WIDTH DIRECTION
Z PIERCING DIRECTION 21 PIERCE BLADE
21b BLADE EDGE
30 BACKUP PLATE
31 INSERTION HOLE
X LONGITUDINAL DIRECTION
Y WIDTH DIRECTION

| | |
|---|---|
| 20 | PIERCE TERMINAL |
| 21 | PIERCE BLADE |
| 21a | side surface |
| 30 | BACKUP PLATE |
| 31 | INSERTION HOLE |
| 102 | FLAT WIRING CONDUCTOR |
| X | LONGITUDINAL DIRECTION |
| Y | WIDTH DIRECTION |
| Z | PIERCING DIRECTION |

20 PIERCE TERMINAL
21 PIERCE BLADE
21b BLADE EDGE
30 BACKUP PLATE
31 INSERTION HOLE
102 FLAT WIRING CONDUCTOR
X LONGITUDINAL DIRECTION
Y WIDTH DIRECTION
Z PIERCING DIRECTION

21 PIERCE BLADE
21b BLADE EDGE
30 BACKUP PLATE
31 INSERTION HOLE
X LONGITUDINAL DIRECTION
Y WIDTH DIRECTION

METHOD FOR CONNECTING CONNECTOR TERMINAL

CROSS-REFERENCE TO RELATED APPLICATIONS

This application is a US national stage filing of patent cooperation treaty (PCT) Appln. No. PCT/JP2008/001951 (WO 2009/013896), filed Jul. 22, 2009, which claims priority to Japanese patent application No. 2007-191936, filed on Jul. 24, 2007, the entire content of which are incorporated herein by reference.

TECHNICAL FIELD

The present invention relates to a method for connecting a connector terminal having a piercing piece that pierces through a thin conductor for example.

BACKGROUND ART

Hitherto, there has been proposed a method for connecting electronic parts with a flat conductor such as a flat cable (see Patent Document 1). This method is arranged so that a crimping piece of a connector is pierced through the flat conductor, i.e., the thin conductor, and a pierced part of the crimping piece is fixed by bending and caulking it. However, there has been a possibility that it becomes difficult to firmly connect the connector and the flat conductor due to the miniaturization of electronic parts.

PATENT DOCUMENT 1: Japanese Patent Application Laid-open No. 2003-142796 Gazette

DISCLOSURE OF INVENTION

Problems to be Solved by the Invention

The present invention aims at providing a method for firmly connecting a connector terminal with a flat conductor.

Means for Solving the Problems

The present invention provides a method for electronically connecting a connector terminal having a piercing piece that pierces through a flat conductor with the flat conductor by the piercing piece and is characterized in that the connection state is adjusted based on a terminal reaction force acting on the boundary surface of the pierced piercing piece and the flat conductor in a step of piercing the piercing piece through the flat conductor.

According to one aspect of the invention, the adjustment of the connection state based on the terminal reaction force may be made by adjusting a pressing reaction force generated when the piercing piece pierces through the flat conductor. According to another aspect of the invention, the adjustment may be made so that the pressing reaction force falls into a range from 30 to 80 N/mm$^2$.

According to a further aspect of the invention, the pressing reaction force may be adjusted by adjusting at least one of a clearance between a punching jig and the piercing piece in piercing the piercing piece and a shape of an edge of the piercing piece.

According to a different aspect of the invention, the piercing pieces are formed of a thin plate having surfaces substantially in parallel with the longitudinal direction and piercing direction and are arrayed in the longitudinal direction, the punching jig is formed of a plate having insertion holes that receive the piercing pieces pierced through the flat conductor and the insertion holes are formed into a shape having a clearance in the thickness direction of the piercing piece to be inserted.

Advantages of the Invention

The invention provides a method for firmly connecting a connector terminal to a flat conductor.

REFERENCE NUMERALS

20 pierce terminal
21 pierce blade
21*a* side surface
21*b* blade edge
30 back-up plate
31 insertion hole
31*a* clearance
102 flat wire conductor
102*a* ruptured end surface
R terminal reaction force
T thickness
X longitudinal direction
Y width direction
Z piercing direction

BEST MODE FOR CARRYING OUT THE INVENTION

Figure 1:
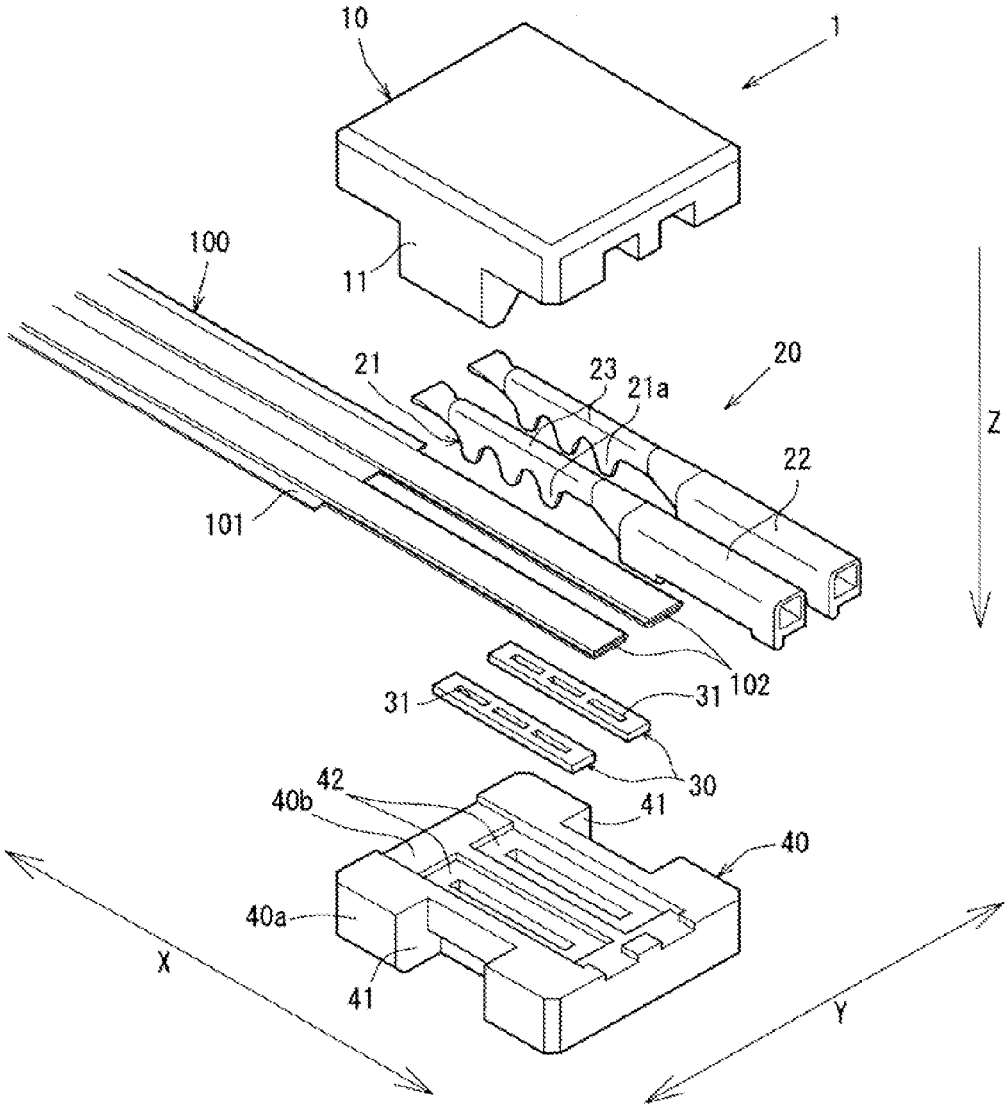
FIG. 1 is an exploded perspective view of a pierce terminal connecting unit for connecting with a flat cable.
Figure 2:
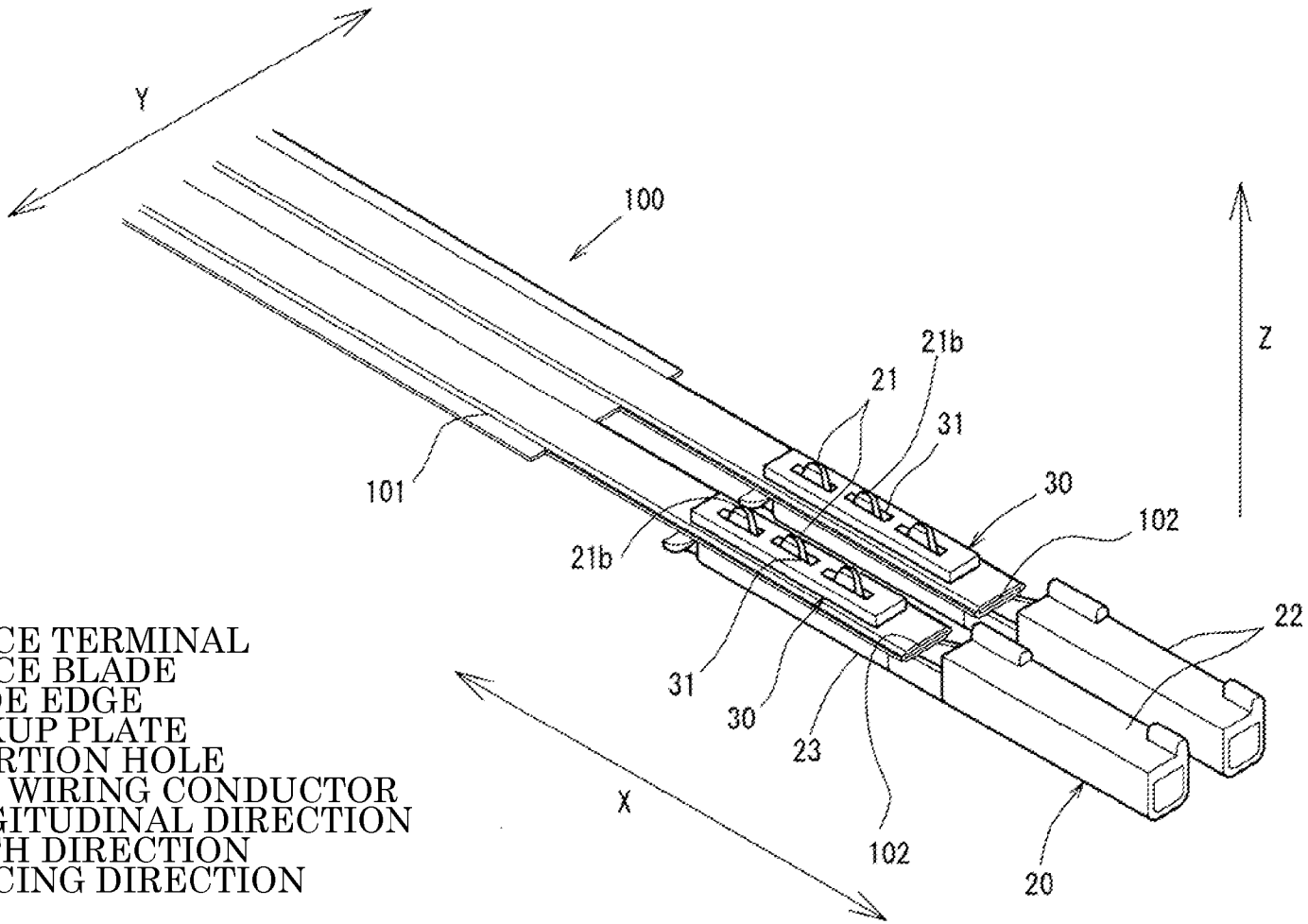
FIG. 2 is a perspective view seen from the bottom side of the flat cable for explaining a state in which the pierce terminal is attached by using a back-up plate.
Figure 3:
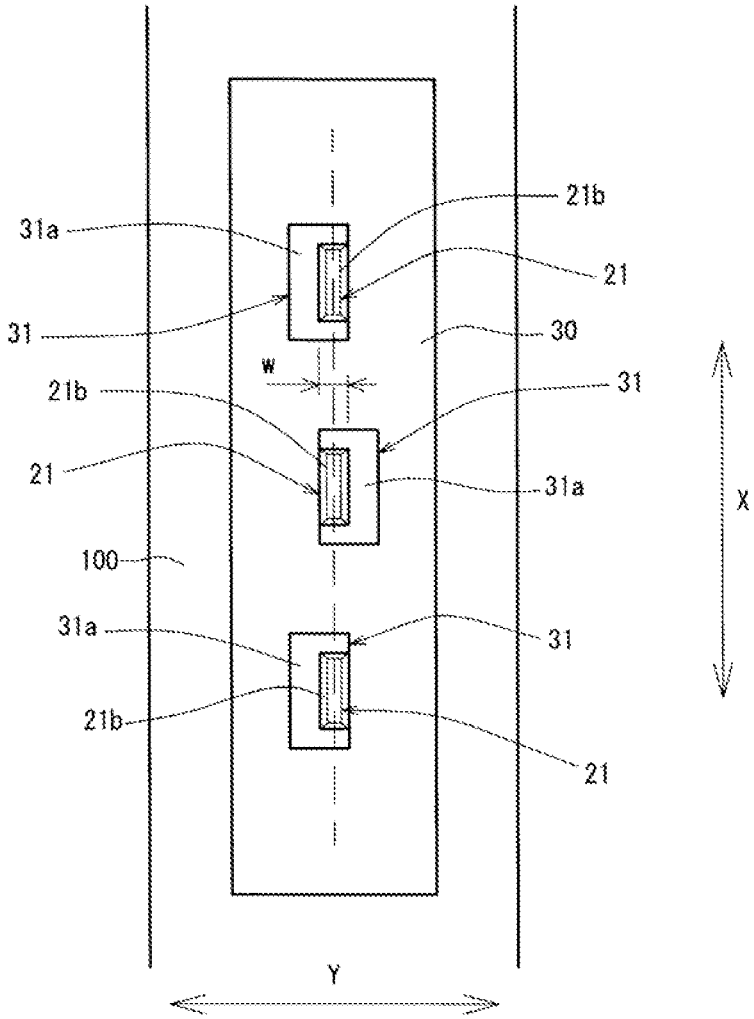
FIG. 3 is an explanatory diagram for explaining a state in which pierce blades are inserted into insertion holes of the back-up plate.

One embodiment of the invention will be explained below with reference to the drawings. That is, a method for connecting a pierce terminal 20 will be explained with reference to FIG. 1 showing an exploded perspective view of a pierce terminal connecting unit 1 for connecting with a flat cable 100, FIG. 2 showing a perspective view seen from the bottom side of the flat cable 100 for explaining a state in which the pierce terminal 20 is attached by using a back-up plate 30, FIG. 3 showing an explanatory diagram for explaining a state in which pierce blades 21 are inserted into insertion holes 31 of the back-up plate 30, FIG. 4 showing an enlarged section view for explaining a state in which the pierce blade 21 is connected with a flat wiring conductor 102 and FIG. 5 showing a graph for explaining a stable connecting range S of pressing reaction force F/A.

The invention provides a method for electrically connecting the pierce terminal 20 having the pierce blades 21 that pierce through the flat conductor 102 with the flat conductor 102 by the pierce blades 21, in which the connection state is adjusted based on a terminal reaction force R acting on the pierced blade 21 by a ruptured end surface 102*a* of the flat wiring conductor 102.

Figure 4:
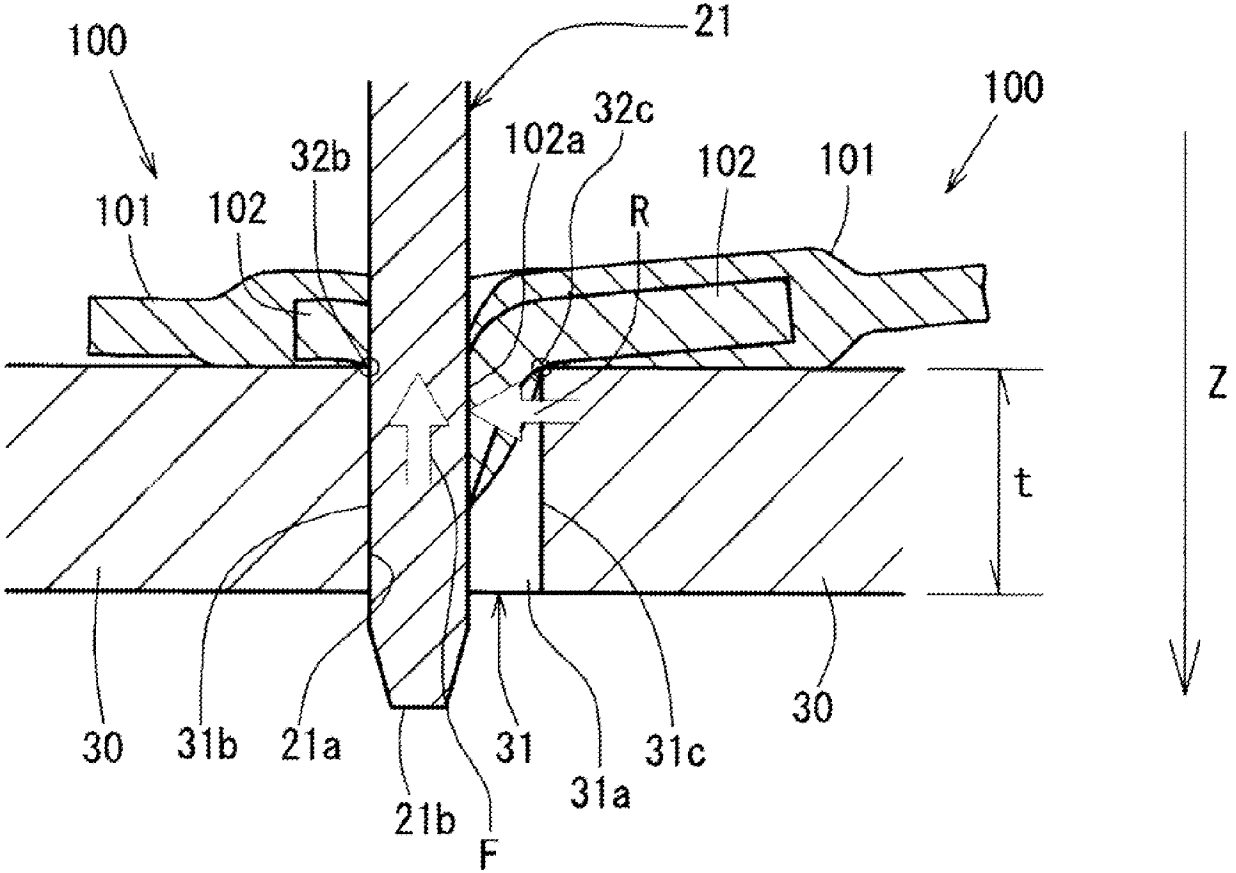
FIG. 4 is an enlarged section view for explaining a state in which the pierce blade is connected with a flat wiring conductor.
Figure 5:
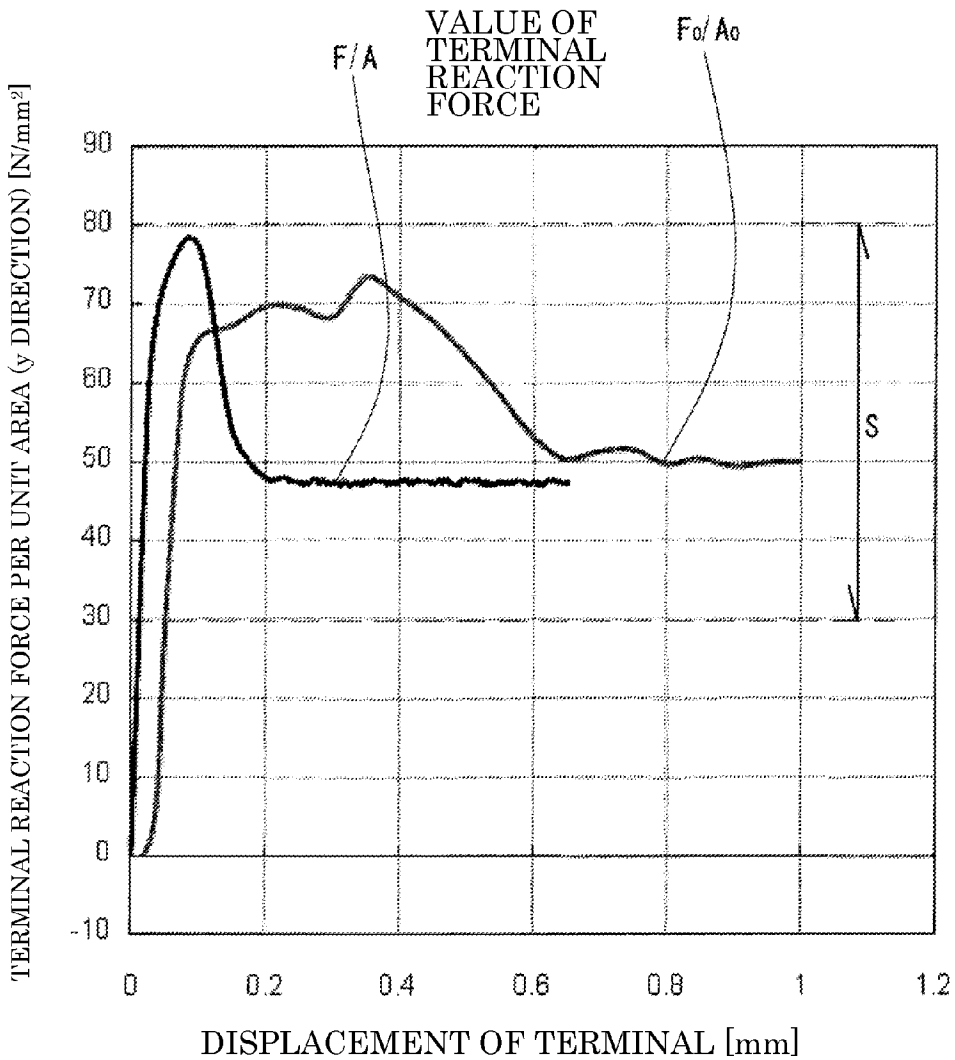
FIG. 5 is a graph for explaining about a stable connecting range of terminal reaction force.

Here, the terminal reaction force R is pressing force acting on the pierce blade 21 through the ruptured end surface 102*a* by the pierced flat wiring conductor 102 as shown in FIG. 4 and is a pressure per unit length of depth.

It is noted that the adjustment of the connection state based on the terminal reaction force R is made by adjusting the pressing reaction force F/A. Specifically, the adjustment is made so that the pressing reaction force F/A falls into a range from 30 to 80 $N/mm^2$ by adjusting a clearance 31*a* between the insertion hole 31 of the backup plate 30 that is a punching jig in piercing the pierce blade 21 and the pierce blade 21 and a shape of a blade edge 21*b* of the pierce blade 21.

Here, the pressing reaction force F/A is a value obtained by dividing an intrusion reaction force F (unit: N) that is a reaction force against an intrusion force for pushing and piercing the pierce blade 21 through the flat wiring conductor 102 by an area A (unit: $mm^2$) of the ruptured end surface 102*a* where the pierce blade 21 contacts with the flat wiring conductor 102.

More specifically, the pressing reaction force F/A is a value obtained by dividing the intrusion force F in a state after when the pushed pierce blade 21 breaks through and widens the flat wiring conductor 102, the broken through part of the flat wiring conductor 102 is widened no more even if the pierce blade 21 moves, i.e., in a state in which the force for pushing the piercing piece is stabilized, by the area A of the ruptured end surface 102*a*.

The invention also provides a connection method in which the pierce blades 21 are formed of a thin plate having side faces 21*a* substantially in parallel with the longitudinal direction X and piercing direction Z and are arrayed in the longitudinal direction X, the punching jig is constructed by the backup plate 30 having the insertion holes 31 that receive the pierce blades 21 that pierce through the flat wiring conductor 102 and the insertion holes 31 are formed into a shape having the clearance 31*a* of 0.025 mm in the thickness direction of the pierce blade 21 to be inserted. This connection method will be detailed below for a case of using the pierce terminal connecting unit 1 in which the pierce terminals 20 described above are unitized.

A flat cable 100 is a flexible flat cable formed by sandwiching two thin plate-like flat wiring conductors 102 whose thickness t is 0.035 mm from its top and bottom by flat insulators 101 whose thickness each other is 0.045 mm.

As shown in FIG. 1, the pierce terminal connecting unit 1 is composed of the two pierce terminals 20, a pierce terminal holder 10 for holding the pierce terminals 20, the backup plate 30 having the insertion holes 30 that receive the pierce blades 21 pierced through the flat cable 100 and a plate holder 40 for holding the backup plate 30.

As shown also in FIG. 1, the pierce terminal 20 is composed of a concave inserting portion 22 into which a male-type terminal not shown is inserted, an inverted U-shaped frame portion 23 that extends from the concave inserting portion 22 and the three pierce blades 21 formed at equal intervals at the lower edge of the frame portion 23. It is noted that the pierce blade 21 has the side surface 21*a* formed in parallel with the longitudinal direction X and the piercing direction Z and a blade edge 21*b* formed into a shape of downward trapezoidal square pyramid at the lower edge of the pierce blade 21. The blade edges 21*b* are arrayed in a row in the longitudinal direction X.

It is noted that the longitudinal direction X is a direction in which the pierce terminal 20 and the flat cable 100 to which the pierce terminal 20 is connected extend. Further, the piercing direction Z is a direction in which the pierce blade 21 pierces through the flat cable 100, i.e., a direction of thickness of the flat cable 100. Still more, a direction of thickness of the pierce blade 21 having the side surface 21*a* and formed into a thin plate is a direction Y of width of the flat cable 100 to which the pierce terminal 20 is connected.

The pierce terminal holder 10 has an attaching section for attaching the pierce terminal 20 at its bottom face and is constructed so as to fit with the plate holder 40 described later by anchoring anchor hooks 11 provided at the lower ends of the both right and left sides of the pierce terminal holder 10.

The backup plate 30 is formed into a rectangular shape having substantially equal length with the frame portion 23 when seen in plan and has the three insertion holes 31 penetrating through the backup plate 30 in the longitudinal direction X. It is noted that the backup plate 30 is disposed on the side opposite from the side in which the pierce blade 21 is pierced so that a corner portion of the insertion hole 31 may become a piercing fulcrum and the intrusion force of the pierce blade 21 may be effectively applied to the flat cable 100 in piercing the flat cable 100 by the pierce blade 21.

It is noted that the insertion holes 31 are disposed at equal intervals with the pierce blades 21 in the longitudinal direction X and are formed so as to have flat faces having the clearance 31*a* on one side when the pierce blade 21 is inserted as shown in FIG. 3. The clearance 31*a* is set at 0.025 mm in the present embodiment.

Still more, the insertion holes 31 are disposed so as to alternately shift by a predetermined distance w in the width direction Y, i.e., are staggered, with respect to the pierce blades 21 that pierce straightly through the width-wise center of the flat wiring conductor 102.

The plate holder 40 has two mounting concave portions 42 for mounting the backup plate 30 disposed in parallel in the width direction Y. The plate holder 40 has also anchoring concave portions 41 where the anchoring hooks 11 described above are anchored on side surfaces 40*a* thereof.

The pierce terminal 20 may be connected with the flat wiring conductor 102 by assembling the pierce terminal holder 10, the pierce terminal 20, the backup plate 30 and the plate holder 40 constructed as described above.

Specifically, the pierce terminal 20 is attached to the pierce terminal holder 10 at first. Then, the backup plate 30 is mounted on the mounting concave portion 42 of the plate holder 40, the flat cable 100 is disposed between the pierce terminal holder 10 and the plate holder 40 and then the pierce terminal holder 10 is fitted with the plate holder 40.

Thereby, the pierce blades 21 of the pierce terminal 20 pierce through the flat cable 100 and the pierce terminal 20 may be connected with the flat wiring conductor 102 in a state in which the pierce blades 21 that break through the flat cable 100 are inserted into the insertion holes 31 as shown in FIGS. 2 and 3.

It is noted that because the backup plate 30 is disposed on the bottom surface side of the flat cable 100, the backup plate 30 functions as a punching jig when the pierce blades 21 pierce through the flat cable 100.

Then, the flat wiring conductor 102 on the side where the pierce blade 21 contacts with an inner side 31*b* of the insertion hole 31 is shear-ruptured by the blade edge 21*b* of the pierce blade 21 and an upper corner 32*a* of the inner side 31*b* when the pierce blade 21 is inserted as shown in FIG. 4.

In contrary, the flat wiring conductor 102 on the side of the clearance 31*a* is ruptured by being elongated by the intrusion force of the pierce blade 21 with a fulcrum of an upper corner of the inner side 31*c*.

At this time, due to the elongated rupture of the flat wiring conductor 102, the ruptured end surface 102*a* of the flat wiring conductor 102 contacts with the side surface 21*a* of the pierce blade 21 with the terminal reaction force R as shown in FIG. 4.

The terminal reaction force R described above satisfies a relationship of:

$$F=\alpha\times R\times A$$

Here, the intrusion reaction force F is a reaction force against the force of pushing the pierce blade 21 into the flat wiring conductor 102 to pierce the pierce blade 21 as described above. It is noted that the intrusion reaction force F acts in a direction opposite from the piercing direction Z, i.e., upward in FIG. 4.

The area A is an area of the ruptured end surface 102 where the pierce blade 21 contacts with the flat wiring conductor 102. $\alpha$ is a coefficient of dynamic friction acting on the side surface 21*a* of the pierce blade 21 and a contact face of the flat wiring conductor 102.

The intrusion reaction force F may be found from results of measurement of a load cell attached to the pierce blade 21 and pierced through the flat wiring conductor 102. It is noted that as shown in FIG. 5, the intrusion reaction force varies depending on a move, i.e., a displacement, of the pierce blade 21 and it assumes a maximum value when the pierce blade 21 breaks through the flat wiring conductor 102 and stabilizes thereafter. A value taken when the force is stabilized is adopted as the intrusion reaction force F.

The area A may be measured by pulling out the pierce blade 21 pierced through the flat wiring conductor 102 once and by measuring an area of an exposed part of the flat wiring conductor 102 whose coating is removed by means of image processing or the like.

The intrusion reaction force F and a length of the ruptured end surface 102*a*, i.e., the area A, vary with parameters of the shape of the blade edge 21*b* and the gap of the clearance 31*a*. In the present embodiment in which the shape of the blade edge 21*b* is formed as the downward trapezoidal square pyramid and the clearance 31*a* is set at 0.025 mm, the pressing reaction force F/A is 48 N/mm$^2$ and the length of the ruptured end surface 102*a* is 0.12 mm, so that the pierce blade 21 may be firmly connected to the flat wiring conductor 102.

It is noted that the present embodiment in which the parameters are set as described above assures the favorable connection state since the pressing reaction force F/A falls within a stable connection range S as shown in FIG. 5. This stable connection range S is set from 30 to 80 N/mm$^2$ based on a reference pressing reaction force $F_0/A_0$ obtained in the case of the flat wiring conductor 102 whose thickness $t_0$ is 0.15 mm, where the intrusion reaction force F and the area A are known and the steady connection state has been confirmed.

When the shape of the blade edge 21*b* is formed into the downward trapezoidal square pyramid and the clearance 31*a* is set to be far larger than 0.025 mm for example, the flat wiring conductor 102 largely elongates with a fulcrum of the upper corner 32*c* by the intrusion force of the pierce blade 21 and the ruptured end surface 102*a* is prolonged. However, the terminal reaction force R becomes extremely small. Accordingly, although the length of the ruptured end surface 102*a*, i.e., the area A contacting with the side surface 21*a*, may be assured, the pressing reaction force F/A is so small that deviates out of the stable connection range S and it is unable to obtain a stable connection state.

In contrary, when the clearance 31*a* is set to be far smaller than 0.025 mm, the flat wiring conductor 102 is shear-ruptured with the fulcrum of the upper corner 32*c* by the intrusion force of the pierce blade 21 and the length of the ruptured end surface 102*a* becomes extremely short. At this time, the pressing reaction force F/A becomes so large that it deviates out of the stable connection range S. However, it is unable to assure the length of the ruptured end surface 102*a*, i.e., the area A that contacts with the side surface 21*a*, so that it is unable to obtain the stable connection state.

Thus, it is possible to obtain the adequate connection state corresponding to the thickness t by setting the stable connection range S based on the reference pressing reaction force $F_0/A_0$ adopting the connection of the pierce blade with the flat wiring conductor having the thickness $t_0$ whose stable connection state has been confirmed as the reference pattern and by setting the parameters so that the pressing reaction force F/A falls within the range of the stable connection range S.

It is possible to firmly electrically connect the pierce terminal 20 with the flat wiring conductor 102 by adjusting the connection state based on the terminal reaction force R acting on the piercing pierce blade 21 and the ruptured end surface 102*a* of the flat wiring conductor 102 in connecting the pierce terminal 20 having the plurality of pierce blades 21 that pierce through the flat wiring conductor 102 as described above. Still more, because the connection state is adjusted by the terminal reaction force R that varies depending on the pierce state, it is possible to assure a desirable connection state and to realize the reliable connection of the pierce terminal 20.

It is also possible to assure the constant connection state regardless of the thickness and the shape of the pierce blade 21 and the flat wiring conductor 102 for example by making the adjustment of the connection state based on the terminal reaction force R by the pressing reaction force F/A generated when the pierce blade 21 pierces through the flat wiring conductor 102 and by adjusting so that the pressing reaction force F/A falls within the range from 30 to 80 N/mm$^2$.

Still more, the pressing reaction force F/A is adjusted by the clearance 31*a* between the insertion hole 31 of the backup plate 30 and the pierce blade 21 in piercing the pierce blade 21 and by the blade edge 21*b* of the pierce blade 21, so that the connection state in which the adequate terminal reaction force R acts may be realized.

Further, the three pierce blades 21 are formed in the longitudinal direction X of the thin plate having the side surfaces 21*a* substantially in parallel with the longitudinal direction X and the piercing direction Z, the punching jig is constructed by the backup plate 30 having the insertion holes 31 that receive the pierce blades 21 that pierced through the flat wiring conductor 102 and the insertion holes 31 are formed into the shape having the clearance 31*a* in the thickness direction of the pierce blades 21 to be inserted.

Thereby, the pierce terminal 20 may be connected with the flat wiring conductor 102 by using the backup plate 30 having the insertion holes 31 as the punching jig and by inserting the pierce blades 21 into the insertion holes 31. Further, the adjustment of the connection state of the pierce terminal 20 may be made by adjusting the clearance of the insertion holes 31, i.e., the shape of the insertion holes 31.

Still more, the insertion holes 31 of the backup plate 30 are staggered by shifting alternately in the width direction Y by the predetermined distance w in the present embodiment, so that the pierce blades 21 piercing through the flat cable 100 are arranged such that the opposing side surfaces 21*a* of the two or more pierce blades 21 contact with the inner side surfaces 31*b* of the insertion holes 31 as shown in FIG. 3. That is, the right inner side surface 31*b* of the upper insertion hole 31 in the figure contacts with the side surface 21*a* of the pierce blade 21, the left inner side surface 31*b* of the middle insertion hole 31 contacts with the side surface 21*a* and the right inner side surface 31*b* of the lower insertion hole 31 contacts with the side surface 21*a*.

Then, frictional resistance of the surface contact between the side surface 21*a* of the pierce blade 21 and the inner side surface 31*b* of the insertion hole 31 prevents the inserted pierce blade 21 from being pulled out of the insertion hole 31. That is, the pierce terminal 20 may be attached to the flat cable 100 in the stable connection state as described above without bending the pierce blade 21 pierced through the flat cable 100.

It is noted that although the parameters are set such that the pressing reaction force F/A in the flat wiring conductor 102 whose thickness t is thinner than the thickness $t_0$ of the reference pressing reaction force $F_0/A_0$ fall within the stable connection range S in the present embodiment, the favorable connection state similar to the case of the thickness $t_0$ may be realized even if the thickness is thicker than the thickness $t_0$ of the reference pressing reaction force $F_0/A_0$ by setting so that the parameters such as the clearance fall within the stable connection range S.

While the flat conductor of the invention corresponds to the flat wiring conductor 102, the piercing piece corresponds to the pierce blade 21, the connector terminal corresponds to the pierce terminal 20, the terminal reaction force corresponds to the terminal reaction force R, the pressing reaction force corresponds to the pressing reaction force F/A, the boundary surface corresponds to the ruptured end surface 102*a*, the punching jig corresponds to the backup plate 30, the edge shape corresponds to the blade edge 21*b* and the plate corresponds to the backup plate 30 in the correspondence between the structure of the invention and the embodiment described above, the invention is not limited to the structure of the embodiment described above and various embodiments may be made.

What is claimed is:

1. A method for electrically connecting a connector terminal having a piercing piece for piercing through a flat conductor, comprising:

piercing the piercing piece through a boundary surface of said flat conductor to establish a connection state;

inserting at least two blades of the piercing piece through at least two insertion holes of a back plate disposed on a side of the flat conductor opposite the boundary surface, wherein the at least two insertion holes are staggered in a width direction; and adjusting the connection state based on a terminal reaction force acting on the boundary surface between the piercing piece and the flat conductor.

2. The method for connecting the connector terminal according to claim 1, wherein the adjusting the connection state based on the terminal reaction force includes adjusting a pressing reaction force generated when the piercing piece pierces through said flat conductor.

3. The method for connecting the connector terminal according to claim 2, wherein the adjusting includes adjusting the connection state to reduce the pressing reaction force to within a range from 30 to 80 Newtons per square millimeter ($N/mm^2$).

4. The method for connecting the connector terminal according to claim 2 or 3, wherein the adjusting the pressing reaction force includes adjusting at least one of a clearance between the at least two insertion holes and the at least two blades of the piercing piece in piercing the piercing piece through the flat conductor, or a shape of an edge of the at least two blades of the piercing piece.

5. The method for connecting the connector terminal according to claim 4, comprising:

forming the piercing piece as a thin plate having surfaces substantially in parallel with a longitudinal direction and a piercing direction, and arrayed in the longitudinal direction; and forming the at least two insertion holes into a shape having a clearance in a thickness direction of said piercing piece.

* * * * *